US006749156B1

(12) United States Patent
Buehlmeyer et al.

(10) Patent No.: US 6,749,156 B1
(45) Date of Patent: Jun. 15, 2004

(54) HOLDING DEVICE FOR HOLDING LONG OBJECTS, ESPECIALLY ROOF DRAINAGE GUTTERS, WHICH ARE TO BE ATTACHED TO A BUILDING

(75) Inventors: Thomas Buehlmeyer, Muenster (DE); Stephan Christensen, Luedinghausen (DE)

(73) Assignee: Rheinzink GmbH & Co. KG, Datteln (DE)

( * ) Notice: Subject to any disclaimer, the term of this patent is extended or adjusted under 35 U.S.C. 154(b) by 0 days.

(21) Appl. No.: 10/148,509

(22) PCT Filed: May 26, 2000

(86) PCT No.: PCT/EP00/04839

§ 371 (c)(1),
(2), (4) Date: May 24, 2002

(87) PCT Pub. No.: WO01/38666

PCT Pub. Date: May 31, 2001

(30) Foreign Application Priority Data

| | | |
|---|---|---|
| Nov. 24, 1999 | (DE) | 199 56 480 |
| Nov. 24, 1999 | (DE) | 299 20 604 U |
| Apr. 12, 2000 | (DE) | 200 06 710 U |

(51) Int. Cl.[7] ..... E04D 13/064
(52) U.S. Cl. ..... 248/48.1
(58) Field of Search ..... 248/48.2, 48.1, 248/229.11; 52/11

(56) References Cited

U.S. PATENT DOCUMENTS

| | | | | |
|---|---|---|---|---|
| 2,434,754 A | | 1/1948 | Bassett | |
| 3,630,473 A | * | 12/1971 | Landis | 248/48.2 |
| 4,094,415 A | * | 6/1978 | Larson | 211/57.1 |
| 4,622,785 A | * | 11/1986 | Miller | 52/11 |
| 4,901,954 A | * | 2/1990 | Fairgrieve et al. | 248/48.2 |
| 5,921,402 A | * | 7/1999 | Magenheimer | 211/26 |
| 5,960,591 A | * | 10/1999 | Schluter | 52/11 |

FOREIGN PATENT DOCUMENTS

| | | |
|---|---|---|
| EP | 0691442 | 1/1996 |
| GB | 2231897 | 11/1990 |
| GB | 2335673 | 9/1999 |
| WO | WO 97/18366 | 5/1997 |

* cited by examiner

*Primary Examiner*—Ramon O. Ramirez
*Assistant Examiner*—Amy J. Sterling
(74) *Attorney, Agent, or Firm*—Milde & Hoffberg, LLP

(57) ABSTRACT

Holding device (100) for a roof drainage gutter (1) with gutter brackets (2.n) matched to the contour of the gutter profile, with each gutter bracket provided with a headpiece (3.n) that, in installed condition, is positioned on the end (13) of the gutter bracket toward the building, and with a securing rail (4.n) with a C- or U-shaped profile into which the headpiece may be inserted and secured. The headpiece (3.1) is inserted into the interior of the securing rail (4.n) and is tensioned between the two C- or U-shaped profile arms (8.1, 8.2) of the C- or U-shaped profile.

10 Claims, 5 Drawing Sheets

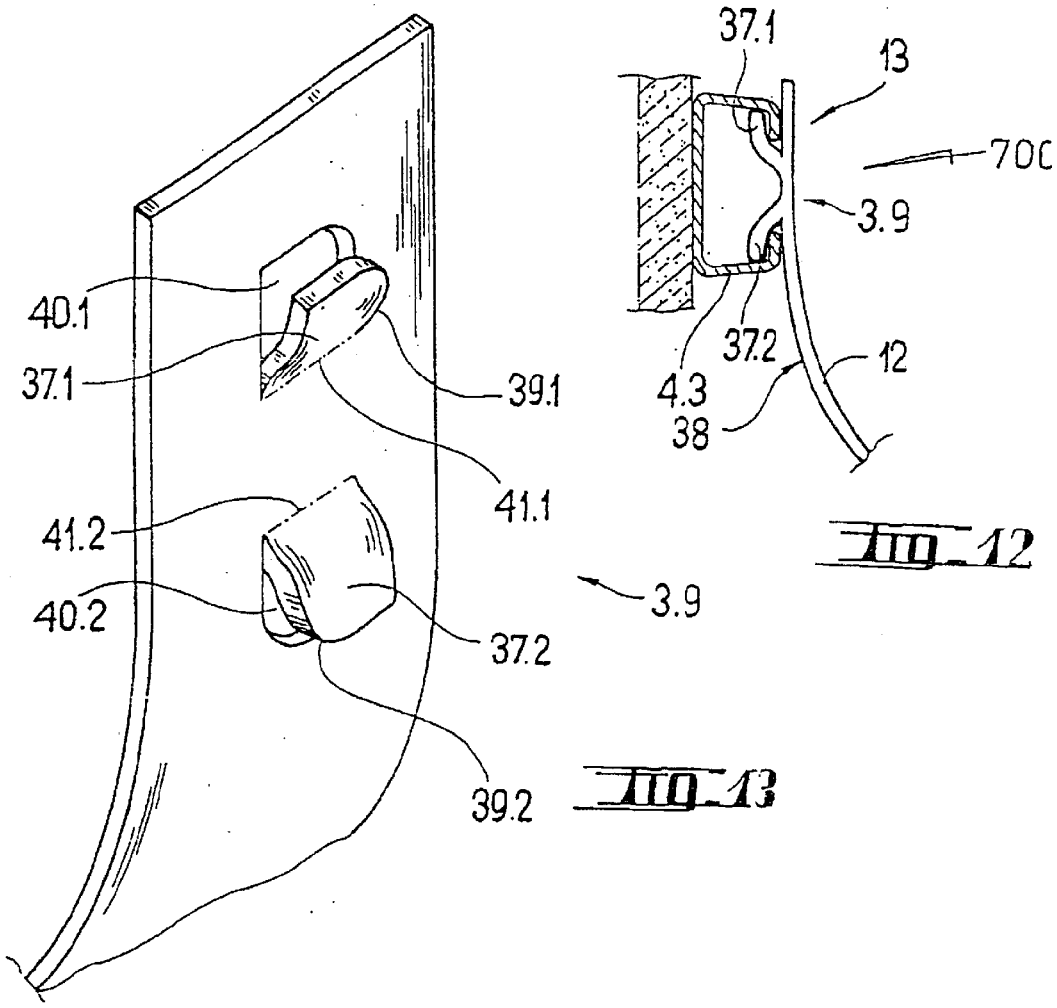
Fig. 12
Fig. 13
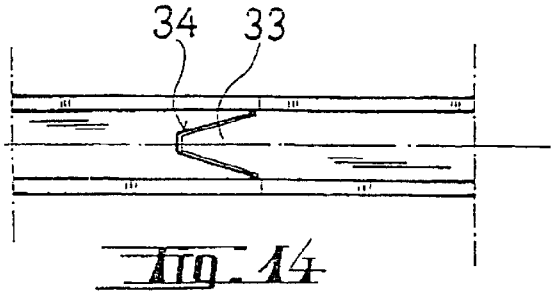
Fig. 14

HOLDING DEVICE FOR HOLDING LONG OBJECTS, ESPECIALLY ROOF DRAINAGE GUTTERS, WHICH ARE TO BE ATTACHED TO A BUILDING

BACKGROUND OF THE INVENTION

The invention relates to a holding device for holding long approximately horizontal objects, especially roof drainage gutters, to a building, that includes at least two strip-shaped gutter holders at a fixed separation from each other and formed about the arc-shaped contour of the gutter profile, each of which is provided with a headpiece that is positioned on the end of the gutter bracket toward the building and that may be inserted into, and hung from, a securing rail parallel to the roof drainage gutters.

A holding device of the type mentioned above is described in U.S. Pat. No. 2,434,754. The holding device includes a gutter bracket with headpiece that is mounted on the end of the arc-shaped piece so that it may swivel about an axis. The gutter bracket accordingly consists of three separate parts that must be assembled, and therefore is very material-and effort-intensive. A stable angle for the gutter bracket is first achieved after insertion of the gutter stiffening the overall holding device. Moreover, the gutter bracket does not comply with modern safety standards because the entire holding device has inadequate strength.

GB-A-2335673 shows a multi-chamber profile secured to the eave into whose C-shaped profile a one-piece gutter bracket may be inserted.

GB-A-2231897 describes a complicated gutter bracket with a headpiece that is provided with an adjustment screw to adapt the gutter bracket to the contour of a particular gutter.

From EP-A-691442, an approximately H-speed gutter bracket for a rectangular gutter is known from which a piece of sheet metal covering the entire holding device is hung. A headpiece of the gutter bracket may be inserted into an opening on the central spar of a securing rail.

Further, W97/18366 shows a holding device with a perforated, trough-shaped longitudinal support to which each gutter bracket is to be secured using a boom and adapter.

SUMMARY OF THE INVENTION

The principal object of the invention is therefore to create a simplified holding device for which the bracket is attached to the securing rail in a safe and stable manner without involving a complicated design of the headpiece and/or of the securing rail.

This object, as well as other objects which will become apparent in the discussion that follows, are achieved, according to the present invention, by providing a bracket for holding long objects, especially roof drainage gutters, for which the headpiece is a sheet-metal or shaped piece formed to the interior of the securing rail, whose thickness is equal to, or slightly smaller than, the depth of the securing rail, and whose width measured in installed condition along the securing rail is less than the distance between the two C- or U-shaped profile arms, so that the headpiece may be inserted into the interior of the C- or U-shaped profile and may be tensioned by rotation through 90°.

The securing rail may consist of a C-, U-, h-, T-, S-, or Z-shaped piece. Other combined profiles into which the headpiece may be inserted or from which it may be hung and simultaneously tensioned or clamped are suitable.

The gutter bracket headpiece undergoes a transition into a known arc-shaped piece, also with rectangular, semi-circle, half-circle, etc. shape, from which the roof drainage gutter may be supported.

The gutter bracket headpiece may be formed in various ways, such as, for example, by suitable bending of the end of the arc-shaped piece, so that is compatible with the interior of the profile. The end of the arc-shaped piece may be bent by approximately 180°, for example, so that the headpiece may be inserted into the interior of the shaped profile and be clamped there.

A U-shaped headpiece may possess a springing shackle extending in non-tensioned state that is compressed upon insertion into a perforation of the securing rail, and that relaxes after it passes the perforation. Such a shackle may be one piece with arc-shaped part of the gutter bracket or as a special profiled piece that is connected by friction fit with the gutter bracket.

Particularly low-cost manufacture of the gutter bracket may be achieved by a simple pressing of two projecting tongues out of the arc-shaped part material that may also be inserted into the interior of the C-shaped or U-shaped profile. Such projecting tongues may also be formed by welding a matching shaped piece to the arc-shaped part. In this case, the shaped piece may consist of flat iron from which two projecting tongues are formed by bending.

The bracket may consist of a securing rail provided with rows of perforations, and of gutter brackets whose headpiece is a stud or spar connected with the arc-shaped piece by means of a spacer, and whose thickness is smaller than the distance between the C- or U-shaped arms of the C- or U-shaped pieces, and whose length exceeds the clear width of the C- or U- shaped pieces so that the gutter bracket may be hung by the insertion of its headpiece into the interior of the C- or U-shaped pieces and rotation by 90°.

The elements of the bracket may be made of metal or plastic.

The holding device based on the invention is suitable for various gutter bracket shapes such as trapezoid, quadrilateral, triangular, quarter-circle, or part of an ellipse. The bracket is equipped either with two springs or with catch and spring to attach the roof drainage gutters.

It is also possible to use the bracket based on the invention to secure balcony flower boxes.

A fraction-fit is produced by rotation or insertion of the gutter bracket that takes advantage of leverage during installation in a simple manner. Loads such as water or snow, wind suction or pressure are presented with reduced leverage by a relatively low profile of the securing rail because of the relatively small thickness of the headpiece and spacer piece. Thus, bending moments arise only because of the positioning of the gutter bracket under load.

The distances between the gutter bracket and the required dimensions of the gutter bracket previously were taken from the building sub-structure, the assignment to corresponding stress groups defined in DIN Norm EN 612, and from experience. The holding device based on the invention represents a new securing system for which the varying thickness and width of the required gutter bracket are no longer determined, but rather for which the number of gutter brackets per established spacing unit for a defined stress group. The gutter bracket is defined only in one advance dimension for the various sizes of the roof gutters. The separation between individual gutter brackets results from the assignment to a stress group. Here, the distance between individual gutter brackets are contained in a table.

First, a clear simplification of installation and eventual servicing, and second, a reduction in work costs are achieved with the bracket based on the invention, since the bracket may be installed by a single person.

For a full understanding of the present invention, reference should now be made to the following detailed description of the preferred embodiments of the invention as illustrated in the accompanying drawings.

BRIEF DESCRIPTION OF THE DRAWINGS

FIG. 12 is another embodiment example of the headpiece secured in the securing rail.

FIG. 13 is a detailed perspective view of the gutter bracket head as in FIG. 12.

FIG. 14 is a schematic view of the junction between two securing rails.

DESCRIPTION OF THE PREFERRED EMBODIMENT

Figure 1:
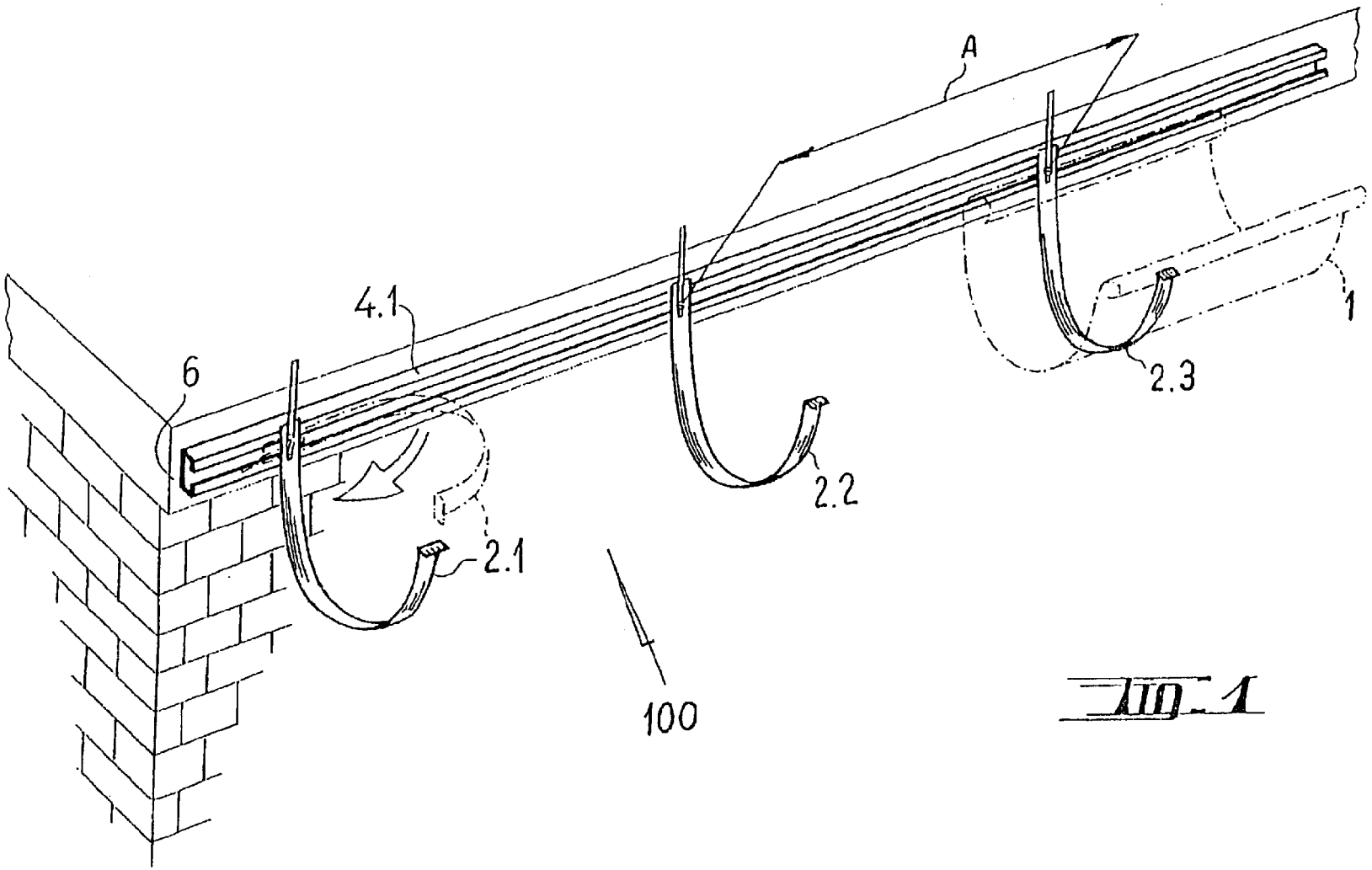
FIG. 1 is a perspective view of a securing rail with brackets attached to a molding.

The preferred embodiments of the present invention will now be described with reference to FIGS. 1–14 of the drawings. Identical elements in the various figures are designated with the same reference numerals.

FIG. 1 shows a securing rail 4.1 that is mounted on molding 6 using dowels and screws (not shown). The securing rail 4.1 is aligned in advance using a laveling device by establishing a suitable slope, and then attached. Gutter brackets 2.1, . . . , **2.*n* are hung from the securing rail 4.1 at a pre-determined interval A without attachment hardware (the illustration shows only three gutter brackets). The interval A between gutter brackets results from the assignment to a stress group. The securing rail 4.1 and the gutter brackets 2.1, . . . , 2.*n* with pertinent attachment elements such as dowels, bolts, or shackles, form a holder 100 for roof drainage gutters 1 (see FIG. 1**, dotted line to the right).

In this manner, a new securing system for roof drainage gutters is presented in which only the number of gutter brackets must be observed for a pre-determined spacer distance unit for a specified stress group. The securing rail 4.1 is made of a metallic C-shaped profile made of a special titanium-zinc alloy for roof and facade elements (trade name RHEINZINK; manufacturer—Rheinzink GmbH & Co. KG in Datteln, Germany). The elements made of the material, in this case securing rail, gutter brackets, and roof drainage gutters, are weather-resistant and practically service-free.

The C-shaped profile consists of a middle stay 18 and of two C-shaped profile lateral sides 8.1, 8.2 aligned with each other, and is very small in cross-section, i.e., the width of the C-shaped profile is many times greater than its thickness. Specifically, the C-shaped profile possesses a depth H measured between the C-shaped profile arm and the center spar and a distance C between the two C-shaped profile arms 8.1, 8.2 that is matched to the dimension of a gutter bracket headpiece 3.1 to be inserted.

Figure 2:
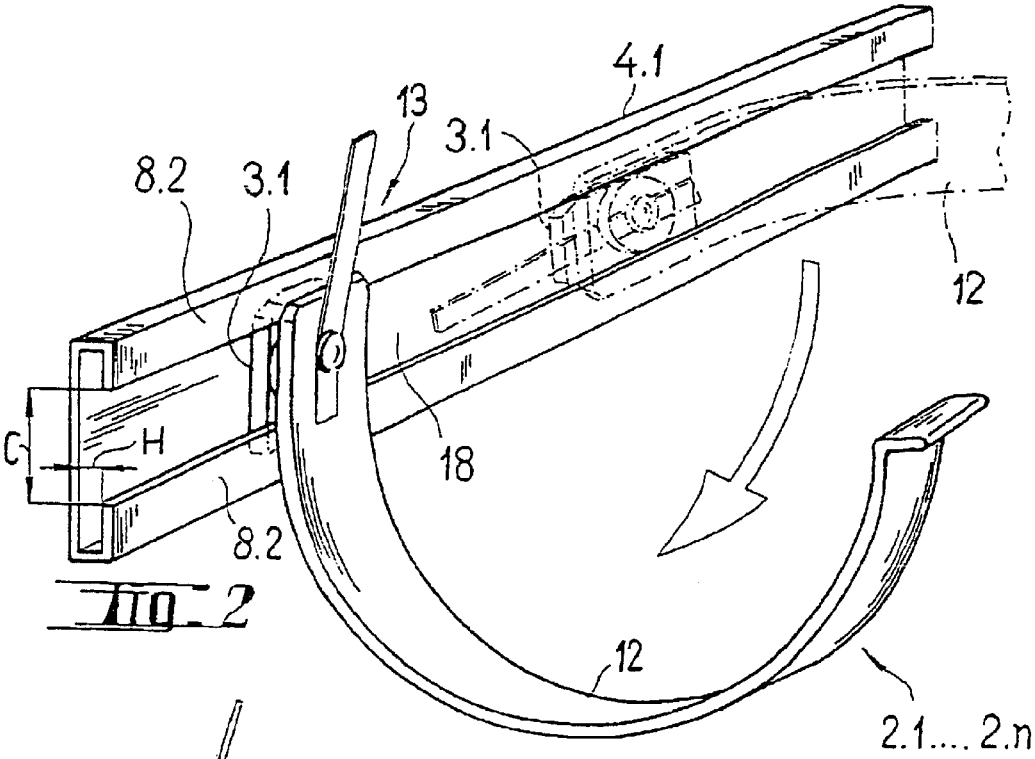
FIG. 2 is a perspective view of the installation of a gutter bracket with a flat headpiece to a securing rail.
Figure 3:
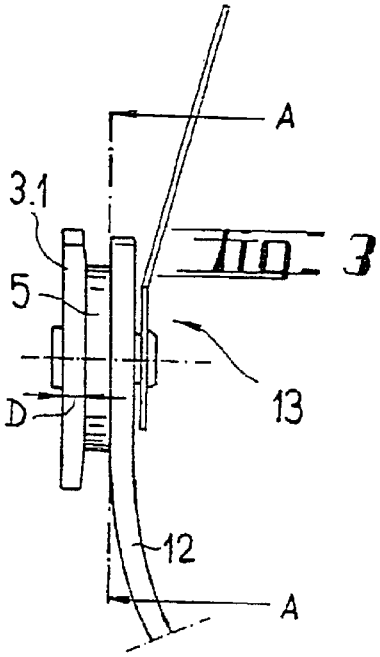
FIG. 3 is a lateral view of a flat headpiece.
Figure 4:
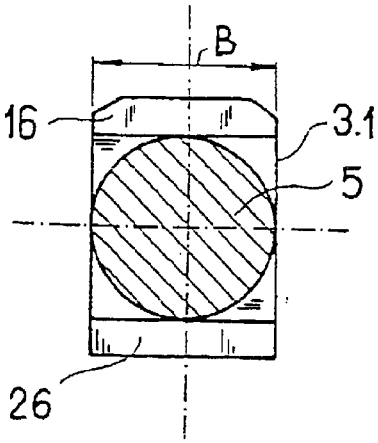
FIG. 4 is a cross-sectional view taken along line A—A as in FIG. 3.

As FIG. 2 shows, the gutter bracket 2.1, . . . , **2.*n* consists of a strip-shaped (bar-shaped) arc-shaped piece 12 and of the headpiece 3.1 positioned on one end 13 of the arc-shaped piece 12 that is to be inserted into the securing rail 4.1 and to be tensioned. The rectangular, flat headpiece 3.1 is connected with the arc 12 via a circular, flat spacer piece 5. The thickness of the spacer piece 5 corresponds to the thickness of the U-lateral side 8.1, 8.2. The headpiece 3.1 has a width B that does not exceed the distance C between the two C-shaped profile arms 8.1, 8.2 of the C-shaped profile, and a thickness D that is slightly greater than the depth H of the C-shaped profile (see FIGS. 3 and 4). In order to form a secure, fitting connection between the gutter bracket and the securing rail, the headpiece 3.1 is lightly tapered at its two narrow sides (see FIG. 4, sections 16 and 26), so that it may be rotated by 90° and clamped after insertion into the C-shaped profile (FIG. 2**, dotted line).

A strip-shaped tab 9 is also attached to the gutter bracket 12 at the same end 13 as the headpiece. This tab 9 is adopted to fold over an edge of the gutter 1 to hold the gutter in place.

Figure 7:
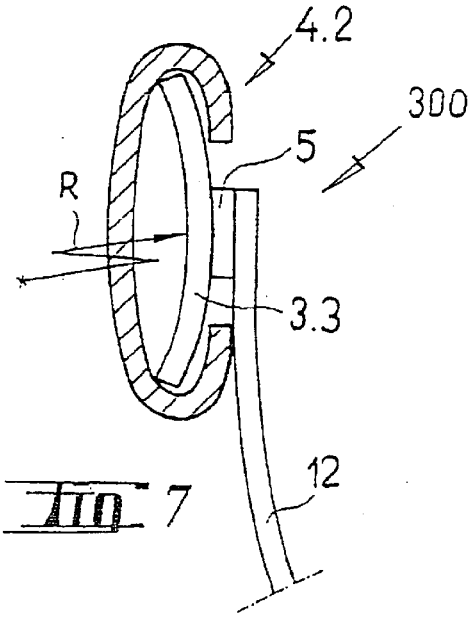

FIG. 7 shows a holding device 300 similar in principle, for which a similarly flattened headpiece 3.3 is designed to be inserted into a securing rail (reference index 4.2). The securing rail is made of a C-shaped profile that is sharply rounded in cross-section, as the illustration shows. The headpiece 3.3 lightly bent about a relatively large radius is tensioned by rotation in the interior of the C-shaped profile.

Figure 5:
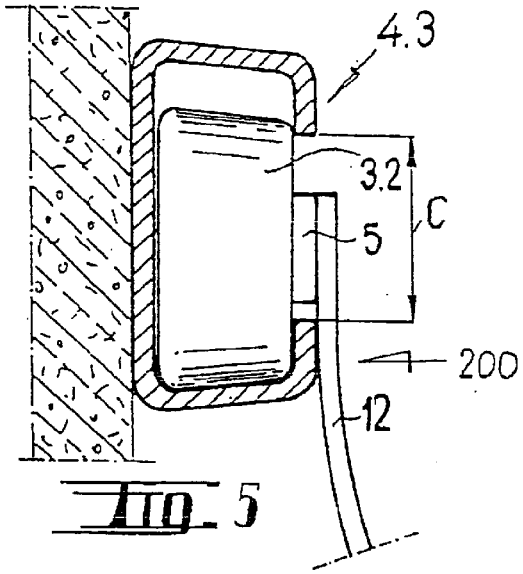
FIGS. 5–7 are cross-sectional views of C-shaped profiles of securing rails with headpieces mounted on them.

FIGS. 5, **6*a*, and 6*b* show another embodiment example of the holding device (reference index 200). A prismatic headpiece 3.2 is inserted into a securing rail 4.3 that is made in the shape of a C-shaped profile tapering toward its longitudinal opening (FIG. 5, cross-section). The headpiece 3.2** also possesses a width (not shown) that does not exceed the distance C between the two C-shaped profile arms.

Figure 6A:
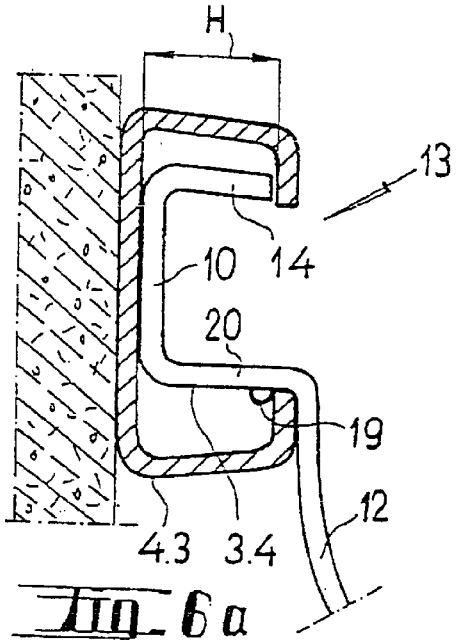
Figure 6B:
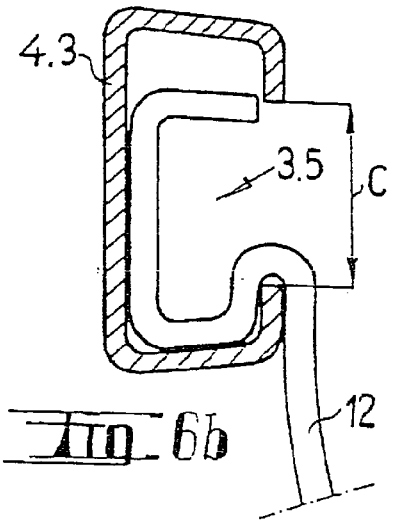

FIG. **6*a* shows an embodiment with a headpiece 3.4 hung on a similar C-shaped profile that is formed by bending the end 13 of the arc-shaped piece 12. The headpiece 3.4 bent into a U shape includes a free U-shaped profile arm whose dimension corresponds to the depth H of the C-shaped profile. FIG. 6*a* also shows a catch 19 that is mounted as a welded bead on a U-shaped profile arm 20 opposite the free U-shaped profile arm 14. The catch 19 and the central spar 10 connecting both U-shaped profile arms 14, 20 ensure that the gutter bracket cannot lever itself out of the securing rail 4.3**.

FIG. **6*b* shows a differently bent headpiece 3.5 that possesses a bead 21 compatible with the lower C-shaped profile arm of the C-shaped profile. Both headpieces 3.4, 3.5** possess a width (not shown) that is less than the distance C between the two C-shaped profile arms of the securing rail.

Figure 8:
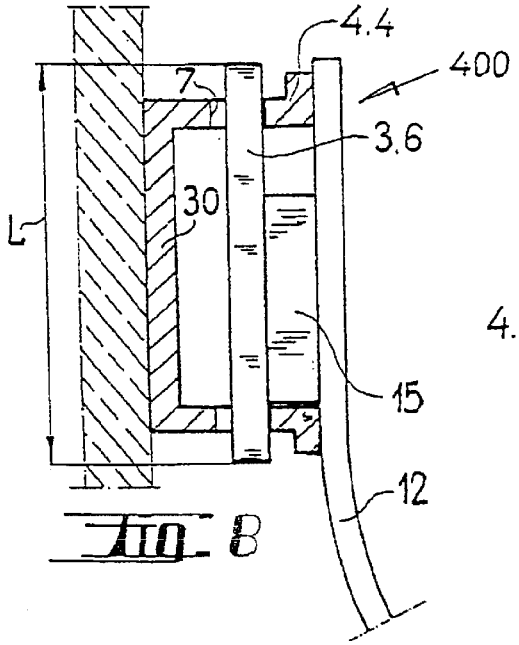
FIG. 8 is a cross-section of a U-shaped profile provided with perforations with inserted headpiece.

FIG. 8 shows another embodiment example of the holding device (reference index 400) for which a securing rail 4.4 made of a U-shaped profile with its center spar 30 is positioned against the wall (e.g., against molding). Each arm of the U-shaped profile includes a row of perforations 7 to receive headpieces 3.6. The bar-shaped headpiece 3.6 formed from a piece of square bar steel is connected via a spacer piece 15 with the arc-shaped piece 12 of the gutter bracket. The headpiece 3.6 includes a length L that is slightly greater than the width of the U-shaped profile so that the gutter bracket with its headpiece may be inserted into the interior of the profile, and may engage with the perforations by a rotation through 90°.

Figure 9:
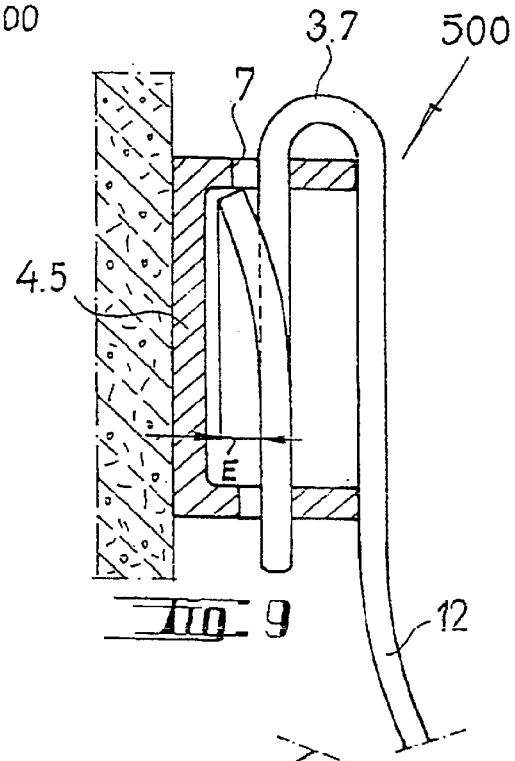
FIG. 9 is a gutter bracket with spring tongue inserted into a perforation.
Figure 10:
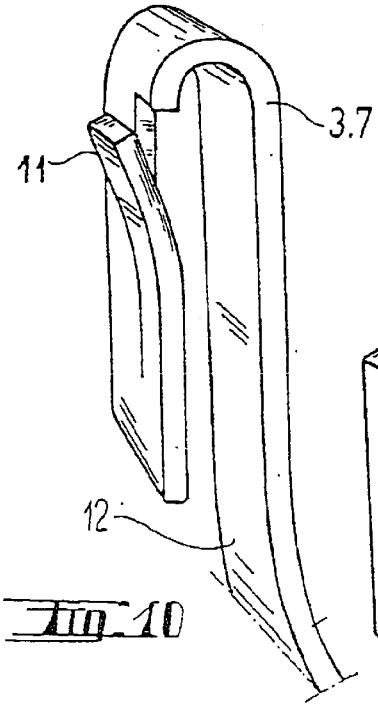
FIG. 10 is a perspective detailed view of the head of a gutter bracket per FIG. 9.

FIG. 9 shows a holding device 500 for which a headpiece 3.7 is inserted into the perforations 7 of a U-shaped profile (securing rail 4.5). A spring shackle 11 may be seen on the free end of the U-shaped headpiece 3.7 that is incorporated into the material of the headpiece, and is bent outward by an amount E (see particularly FIG. 10). The amount E is greater than the difference between the perforation width and the thickness of the headpiece material so that the shackle 11 is compressed together by insertion into the hole, and relaxes after passing the perforations. In the condition shown in FIG. 9, the shackle 11 prevents the gutter bracket from being raised. In order to be able to remove the gutter bracket from the U-shaped profile (during replacement, for example), the shackle 11 must merely be laterally tensioned using a simple tool such as a screwdriver.

Figure 11:
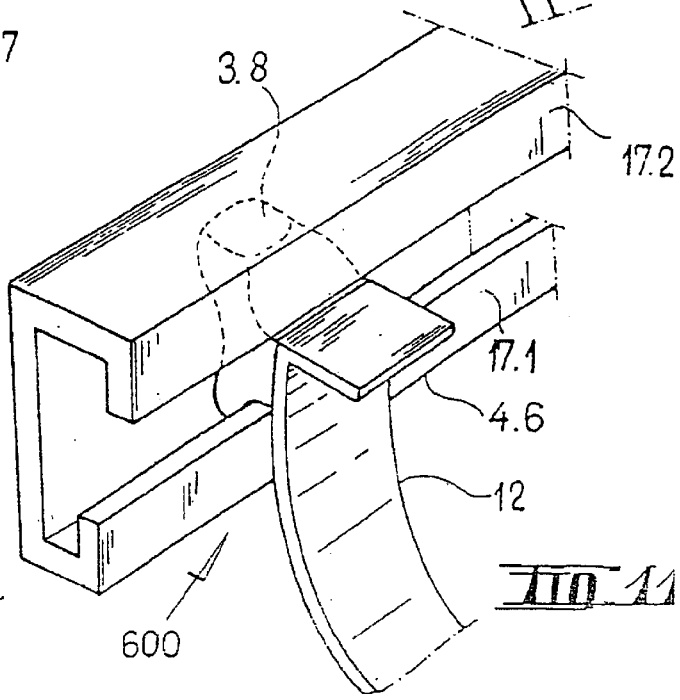
FIG. 11 is a perspective view of another embodiment example of the holding device with a cast headpiece.

FIG. 11 shows another embodiment example of the holding device (reference index 600) for which a cast-aluminum headpiece 3.8 is inserted into a securing rail 4.6 and is affixed there by rotating. The securing rail 4.6 of C-shaped profile with unequal C-shaped profile arms 17.1, 17.2 is divided into lengths. The headpiece 3.8 matched to the interior of the C-shaped profile possesses two opposing rounded areas 36.1, 36.2 that allow the rotation. Further, a recess 37 is provided in the material of the headpiece.

Finally, FIGS. 12 and 13 show a simple holding device 700 for which a headpiece 3.9 is provided by pressing out two insertion tongues 37.1, 37.2 extending away from each other form the material of the arc-shaped piece 12. The arc-shaped piece 12 of the gutter bracket is made from a piece of flat iron. Each of the insertion tongues 37.1, 37.2 possesses a rounded area 39.1, 39.2 that also simplify rotation within the securing rail 4.3. Two recesses 40.1, 40.2 with two curvature lines 41.1, 41.2 parallel to each other are formed by the pressing. The gutter bracket described is particularly stable and inexpensive.

Depending on need, sections of the securing rail are interconnected taking the proper slope (3 to 5 mm per 1 m length) and alignment into account. This is simplified by the insertion of a tongue 33 into a compatible cutout 34 of the neighboring section (see FIG. 14).

There has thus been shown and described a novel holding device for holding long objects, especially roof drainage gutters, which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A holding device for an elongate roof drainage gutter which is to be hung on a building in a substantially horizontal position, said roof drainage gutter having a given profile, said holding device comprising:

(a) at least two gutter brackets positioned at a fixed distance (A) from each other, each of said gutter brackets being strip-shaped and formed to the contour of the gutter profile, and each of said gutter brackets being provided with a headpiece positioned, in installed condition, at the end of the gutter bracket that faces the building;

(b) a securing rail extending parallel to the roof drainage gutter, with a C- or U-shaped profile into which the headpiece may be inserted and held, whereby the headpiece is inserted into the interior of the securing rail through a gap of distance (C) between C or U-shaped profile arms;

(c) a strip attached to the gutter bracket at said end that faces the building, adapted for folding over an edge of the roof drainage gutter, for holding said gutter in place;

wherein the headpiece is attached to the gutter bracket through a spacer having a maximum width which is slightly less than or equal to the distance (C);

wherein the headpiece possesses a thickness (D) slightly less than or equal to, the inner dimension (depth H) of the securing rail; and wherein width (B) of the headpiece in a transverse direction to the gutter bracket is slightly less than or equal to the distance (C) and greater than the distance (C) in a longitudinal direction of the gutter bracket so that the headpiece may be inserted into the interior of the C- or U-shaped profile and thereafter rotated through 90° where it is tensioned and held in place between the C- or U-shaped profile arms of the securing rail.

2. Holding device as in claim 1, wherein the headpiece and the gutter bracket are made as one piece.

3. Holding device as in claim 1, wherein the headpiece is bent.

4. Holding device as in claim 1, wherein the headpiece is tapered and/or rounded on at least one of its narrow sides.

5. Holding device as in claim 1, wherein the headpiece is a shaped piece made of plastic or cast metal.

6. Holding device as in claim 1, wherein the headpiece is formed from two insertion tongues positioned on an end of the arc-shaped piece extending away from each other that extend over an exterior side of the arc-shaped piece.

7. Holding device as in claim 1, wherein the securing rail is provided with a row of perforations.

8. Holding device as in claim 7, wherein the headpiece is provided with a U-shaped end onto which a spring shackle extending outward, in its non-tensioned condition, is compressed when inserted into perforations of the rail, and which is relaxed when it has passed the perforations.

9. Holding device as in claim 8, wherein the spring shackle is bent as one piece with the arc-shaped piece.

10. Holding device as in claim 9, wherein the spring shackle is made of the same material as the arc-shaped piece.

* * * * *